US012557894B2

(12) United States Patent
Sung et al.

(10) Patent No.: US 12,557,894 B2
(45) Date of Patent: Feb. 24, 2026

(54) ARTIFICIAL NAIL AND METHOD OF MANUFACTURING THE SAME

(71) Applicant: KISS NAIL PRODUCTS, INC, Port Washington, NY (US)

(72) Inventors: Siyong Sung, Port Washington, NY (US); Gyeongmin Park, Port Washington, NY (US)

(73) Assignee: KISS NAIL PRODUCTS, INC, Port Washington, NY (US)

( * ) Notice: Subject to any disclaimer, the term of this patent is extended or adjusted under 35 U.S.C. 154(b) by 221 days.

(21) Appl. No.: 18/244,310

(22) Filed: Sep. 11, 2023

(65) Prior Publication Data

US 2025/0082087 A1 Mar. 13, 2025

(51) Int. Cl.
*A45D 31/00* (2006.01)

(52) U.S. Cl.
CPC ..... *A45D 31/00* (2013.01)

(58) Field of Classification Search
None
See application file for complete search history.

(56) References Cited

U.S. PATENT DOCUMENTS 4,554,935 A * 11/1985 Hokama ..... A45D 31/00 132/73
5,450,864 A * 9/1995 LaJoie ..... A45D 31/00 132/73
6,394,100 B1 * 5/2002 Chang ..... A45D 29/001 132/73
7,150,281 B2 12/2006 Han
11,330,888 B1 * 5/2022 Lotti ..... C09J 11/08
2008/0289646 A1 * 11/2008 Fracassi ..... A45D 31/00 132/73
2011/0030711 A1 2/2011 Han
2011/0132386 A1 * 6/2011 Huynh ..... A45D 31/00 132/73
2021/0315360 A1 * 10/2021 Ma ..... C09J 175/14

FOREIGN PATENT DOCUMENTS

KR 20-0224626 5/2001
KR 10-2004-0038596 5/2004
KR 10-1192710 10/2012
KR 10-2013-0100326 9/2013
KR 10-1857695 5/2018
KR 10-2018-0131241 12/2018

* cited by examiner

*Primary Examiner* — Tatiana L Nobrega
(74) *Attorney, Agent, or Firm* — PnK IP LLC

(57) ABSTRACT

An artificial nail includes: an artificial nail body having a shape corresponding to a shape of at least one portion of the natural nail, and including an upper surface provided to be away from a surface of the natural nail and a lower surface structured to face the surface of the natural nail; and an adhesive member disposed on a first surface of the lower surface of the artificial nail body. The lower surface of the artificial nail body includes the first surface overlapping the natural nail when attached to the surface of the natural nail and a second surface other than the first surface, and at least one portion of the first surface has a first roughness greater than a roughness of the second surface.

11 Claims, 7 Drawing Sheets

ARTIFICIAL NAIL AND METHOD OF MANUFACTURING THE SAME

BACKGROUND

Field

Embodiments of the invention relate generally to an artificial nail, and more particularly, to an artificial nail including an adhesive member disposed on a surface thereof in contact with a natural nail and method of manufacturing the same.

Discussion of the Background

It is known in the art of adorning the hands or feet to provide ornamental nail accessories made from thin, molded plastic members manufactured generally in the shape of a fingernail or toenail.

Conventional artificial nails are made of a material such as synthetic resin in a predetermined shape, and generally, when used, a liquid adhesive is applied to a user's natural nail and then trimmed into a nail shape according to the user's preference. However, since the liquid adhesive for attaching the artificial nail very firmly adheres the artificial nail body to the natural nail, the nail body can only be removed using a liquid remover. In addition, because liquid adhesives as well as these removers are chemicals that are not good for the human body, it is preferable to apply them without contacting the skin as much as possible.

In order to solve this inconvenience, various methods are known, such as a method of attaching an artificial nail to a natural nail using double-sided tape or a method of applying an adhesive to the bottom surface of an artificial nail. However, these methods have several disadvantages, such as poor adhesive strength compared to conventional liquid adhesives.

The above information disclosed in this Background section is only for understanding of the background of the inventive concepts, and, therefore, it may contain information that does not constitute prior art.

SUMMARY

Artificial nails constructed according to the principles and implementations of the invention and illustrative methods of manufacturing the same are capable of improving adhesive strength of a liquid or gel type adhesive member disposed between a first surface of a lower surface of an artificial nail and a natural nail body because the first surface is surface treated to have a roughness greater than that of other surfaces of the lower surface of the artificial nail body.

In addition, artificial nails constructed according to the principles and implementations of the invention and illustrative methods of manufacturing the same are capable of optimizing the amount and area to which the liquid or gel type adhesive member is applied by forming a guide line pattern inside of the first surface, the guide line pattern defining a position to apply the adhesive member.

Further, artificial nails constructed according to the principles and implementations of the invention and illustrative methods of manufacturing the same are capable of attaching and detaching the artificial nail body from the natural nail more safely because the artificial nail body has a first end edge 11 having a first thickness and overlapping the natural nail, and a second end edge 12 opposite the first end edge 11 having a second thickness different from the first thickness.

That is, the artificial nail body has a shape gradually being thicker from the first end edge to the second end edge.

Additional features of the inventive concepts will be set forth in the description which follows, and in part will be apparent from the description, or may be learned by practice of the inventive concepts.

According to one aspect of the invention, an artificial nail includes: an artificial nail body having a shape corresponding to a shape of at least one portion of the natural nail, and including an upper surface provided to be away from a surface of the natural nail and a lower surface structured to face the surface of the natural nail; and an adhesive member disposed on a first surface of the lower surface of the artificial nail body. The lower surface of the artificial nail body includes the first surface overlapping the natural nail when attached to the surface of the natural nail and a second surface other than the first surface, and at least one portion of the first surface has a first roughness greater than a roughness of the second surface.

The artificial nail body may include a first end edge having a first thickness and overlapping the at least one portion of the natural nail, and a second end edge opposite the first end edge having a second thickness different from the first thickness.

The second thickness may be thicker than the first thickness t1 about over four times.

The first thickness may be about 0.12 to 0.15 mm, and the second thickness t2 is about 1 to 1.1 mm.

The artificial nail body may have a shape gradually being thicker from the first end edge to the second end edge.

The artificial nail body may be made of a polymer material having a high gloss property.

The upper surface may have a second roughness greater than the roughness of the second surface by being surface treated.

The second roughness of the upper surface may be lower than the first roughness of the first surface of the lower surface.

The first surface of the lower surface may include a predetermined pattern which is not surface treated and having a roughness same as the roughness of the second surface.

The predetermined pattern may include a pattern in the shape of a number, and the predetermined pattern may be formed by being embossed or debossed.

The first surface of the lower surface further may include a guide line pattern which is not surface treated and having a closed loop shape surrounding a predetermined pattern with a roughness same as the roughness of the second surface.

The guide line pattern may be formed by being embossed or debossed.

The adhesive member may include a photo-curable material.

An optical refractive index of the photo-cured adhesive member and an optical refractive index of the artificial nail body may be substantially the same.

According to another aspect of the invention, a method of manufacturing an artificial nail, the method includes the steps of: arranging at least one artificial nail body having a shape corresponding to a shape of at least one portion of the natural nail, and including an upper surface provided to be away from a surface of the natural nail and a lower surface structured to face the surface of the natural nail; applying a surface treatment at least one surface of the artificial nail body; and disposing an adhesive member on a first surface of the lower surface of the artificial nail body, the first surface having a first roughness by the surface treatment.

The surface treatment may include a laser etching process, and the at least one etched surface of the artificial nail body may include the upper surface of the artificial nail body, the etched upper surface may have a second roughness lower than the first roughness of the etched first surface.

The method may further include the step of: forming a predetermined pattern inside of the first surface during the surface treatment process, the predetermined pattern not being surface treated.

The method may further include the step of: forming a guide line pattern having a closed loops shape surrounding the predetermined pattern inside of the first surface during the surface treatment process, the guide line pattern not being surface treated.

The adhesive member may include a photo-curable material.

The method may further include the step of: curing the adhesive member disposed between the artificial nail body and the natural nail, wherein an optical refractive index of the cured adhesive member and an optical refractive index of the artificial nail body are substantially the same.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION

Figure 1A:
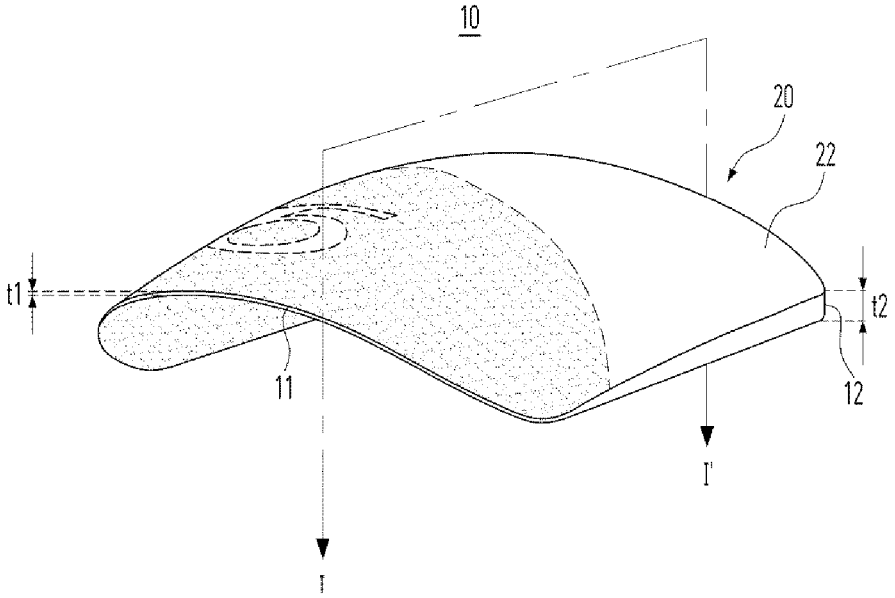
FIG. 1A is a perspective view of an embodiment of an upper surface of an artificial nail body constructed according to the principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 1B:
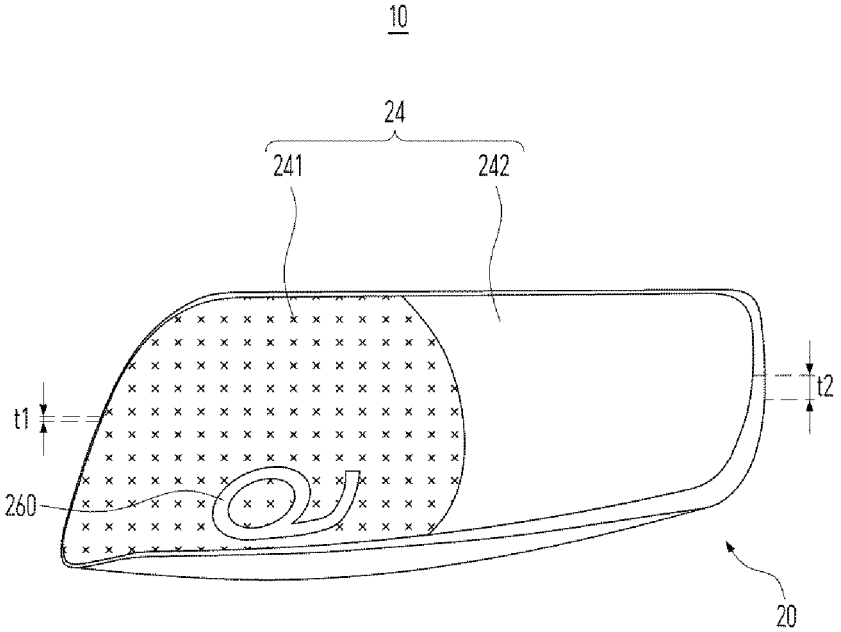
FIG. 1B is a perspective view of a lower surface of the artificial nail body shown in FIG. 1A.
Figure 1C:
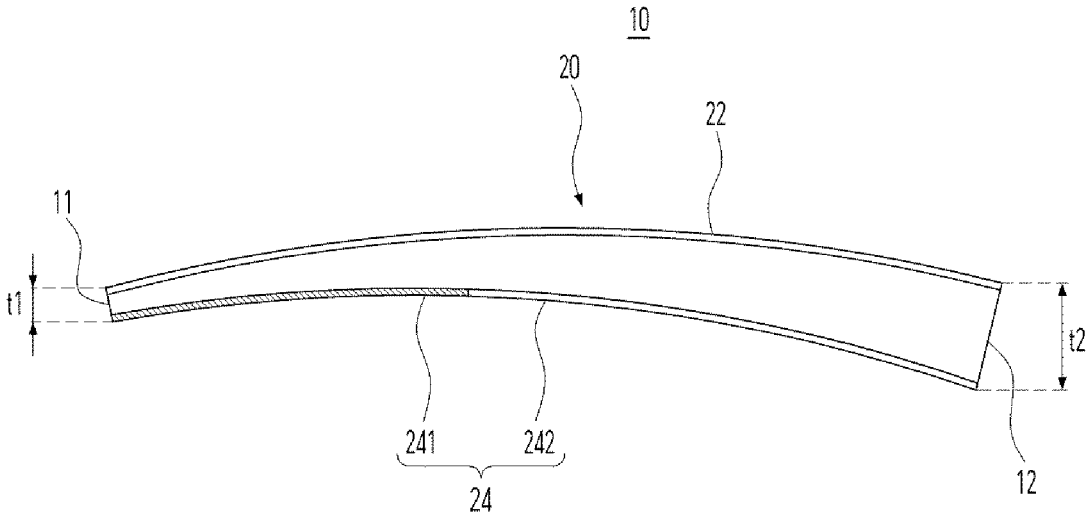
FIG. 1C is a cross-sectional view of the artificial nail body taken along line I-I' of FIG. 1A.
Figure 2:
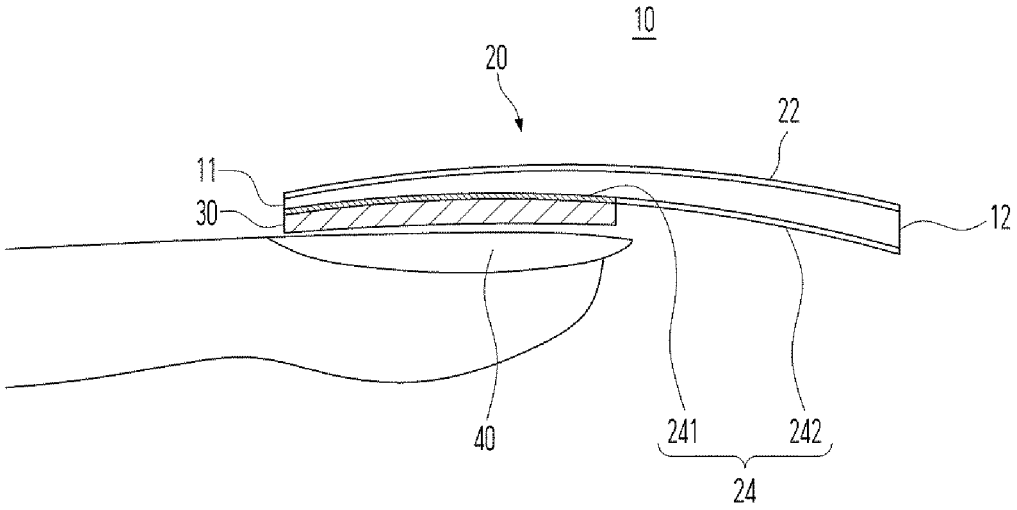
FIG. 2 is a cross-sectional view illustrating an embodiment in which the artificial nail body shown in FIGS. 1A to 1C is attached to a natural nail by an adhesive member.

FIG. 1A is a perspective view of an embodiment of an upper surface of an artificial nail body constructed according to the principles of the invention, FIG. 1B is a perspective view of a lower surface of the artificial nail body shown in FIG. 1A, and FIG. 1C is a cross-sectional view of the artificial nail body taken along line I-I' of FIG. 1A. Further, FIG. 2 is a cross-sectional view illustrating an embodiment in which the artificial nail body shown in FIGS. 1A to 1C is attached to a natural nail by an adhesive member.

FIGS. 1A, 1B, 1C, and 2 show an artificial nail 10 according to a first embodiment of the invention. The term "artificial nail" can include, but is not limited to, a full-cover nail intended to be applied over the entire surface of a user's natural nail (e.g., a finger nail or a toe nail), a nail extension or "nail tip" intended to be applied to at least one portion of the user's natural nail, and the like.

Referring to FIGS. 1A, 1B, 1C and 2, an artificial nail 10 according to the embodiment is curved with a predetermined curvature similar to the shape of a natural nail 40 and includes an artificial nail body 20 having a concave lower surface 24 and an adhesive member 30 disposed onto a first surface 241 of the lower surface 24 of the artificial nail body 20. In particular, the lower surface 24 of the artificial nail body 20 according to an embodiment includes the first surface 241 overlapping the natural nail 40 and the first surface is surface treated (e.g., laser-etched) so that the surface roughness of the first surface has a roughness greater than that of other surfaces of the lower surface. Accordingly, an adhesive strength of the adhesive member 40 (e.g., liquid or gel type adhesive material) disposed between the first surface and the natural nail improved.

As shown in FIGS. 1A, 1B, 1C and 2, the artificial nail 10 may include an artificial nail body 20 corresponding to a shape of at least one portion of the natural nail 40. The artificial nail body 20 can be designed as a full-cover nail, a partial artificial nail portion and/or an artificial nail tip.

The artificial nail body 20 according to an embodiment may be formed of a polymer material having a substantially high gloss property.

For example, the artificial nail body 20 can be made from a composition of Acrylonitrile-Butadiene-Styrene (ABS) plastic and a polycarbonate. Further, the artificial nail body 20 can also be made from any plastic-like material commonly employed in the manufacture of artificial nails, such as ABS plastic, nylon, tenite acetate, vinyl acetate, poly carbonates, polyvinyl chloride, etc.

Examples of suitable hard materials for the artificial nail body 20 can include Styrolux® 684D (SBC), a styrene-butadiene block copolymer available from BASF Corporation: Cyro® R40 (acrylic base), an acrylic-based multipolymer available from Cyro Industries of Rockaway, N.J.; Lexane KRO1 (PC) (trade name), a polycarbonate available from GE Plastics; K-resin® (SBC), a styrene-butadiene copolymer available from Chevron Phillips Chemical Company; TP-UXS (MMBS) (trade name), a methyl methacrylate butadiene styrene terpolymer available from DENKA of Tokyo, Japan; Starex® 5010 (ABS), an acrylonitrile butadiene styrene available from Samsung Cheil Industries: Zylar® 220 (SMMC) and Nas (R30, styrene methyl methacrylate copolymers available from Nova Chemicals; and Toyalac 920 (Clear ABS), an acryloritrile butadiene styrene available from Toray Resin Company.

The artificial nail body 20 preferably has a thickness of between about 0.1 and about 1.1 mm, but the thickness may vary according to the application.

An embodiment of the invention may be characterized in that the thicknesses of both ends of the artificial nail body 20 are different from each other.

The artificial nail body 20 may have a first end edge 11 having a first thickness t1 and overlapping the natural nail 40, and a second end edge 12 opposite the first end edge 11 having a second thickness t2 different from the first thickness.

Specifically, the second thickness t2 may be thicker than the first thickness t1 about over four times, as such users can attach and detach the artificial nail body 20 from the natural nail 40 more safely.

In an embodiment, the first thickness t1 may be about 0.12 to 0.15 mm, and the second thickness t2 may be about 1 to 1.1 mm. Therefore, the artificial nail body 20 may have a shape gradually being thicker from the first end edge 11 to the second end edge 12.

Referring to FIGS. 1A, 1B, and 1C, the artificial nail body 20 has an upper surface 22, which is provided to be away from a surface of the user's natural nail 40, and a lower surface 24, which is structured to face a top surface of the user's natural nail 40.

As shown in FIG. 1B, the lower surface 24 of the artificial nail body 20 includes a first surface 241 overlapping the natural nail 40 and a second surface 242 other than the first surface 241, and the first surface 241 is surface treated (e.g., laser-etched) to have a first roughness. Accordingly, the first roughness of the first surface 241 may be greater than a roughness of the second surface 242. For example, the first roughness of the first surface may be obtained by, for example, being laser-etched, but embodiments of the invention are not limited thereto. Thus, not only the laser etching process but also a sand blast method or the like can be applied to the first surface in order to have the first roughness.

Further, as shown in FIG. 1C, when the adhesive member 30 is applied to the first surface 241, since an adhesive strength of the adhesive member 30 is improved by the first roughness of the first surface 241, the artificial nail body 20 can be fixed to the natural nail 40 more stable.

On the other hand, as shown in FIG. 1A, the surface treatment process such as the laser etching process is not performed on the upper surface 22 of the artificial nail body 20, so that high gloss properties can be maintained on the upper surface 22. For example, the second surface 242 of the lower surfaces 24 as well as the upper surface 22 of the artificial nail body 20 are not laser-etched and thus may have high gloss characteristics.

In addition, as shown in FIG. 1B, a predetermined pattern 260 which is not laser-etched may be formed inside of the first surface 241 of the lower surface 24.

For example, referring to FIG. 1B, the predetermined pattern 260 may include the shape of a number, and such a number pattern 260 may perform a function of distinguishing a plurality of artificial nail bodies which are provided in a package. That is, in the case of a package including ten different artificial nail bodies, number patterns (e.g., 1 to 10) may be formed in a predetermined area of the first surface 241 of each artificial nail body. The predetermined pattern 260 may be formed by being embossed or debossed.

Referring to FIG. 1C, the adhesive member 30 disposed on the first surface 241 is configured to adhere to an upper surface of the natural nail 40 when applied thereto. For example, the adhesive member 30 may include, e.g., a copolymer of acrylic ester and vinyl acetate formed from an aqueous acrylic copolymer emulsion. In addition, the adhesive member 30 may contain a pressure-sensitive adhesive material, and preferably may further include a photo-curable material. For example, the adhesive member 30 may include an acrylic oligomer having a viscosity in a gel form.

Therefore, after the adhesive member 30 is applied to the first surface 241 having the first roughness, if the artificial nail body 20 and the adhesive member 30 are attached to the natural nail 40 through a predetermined pressure and light (e.g., UV light) is irradiated for a predetermined time to cure the adhesive member 30, the artificial nail body 20 can be more stably fixed to the natural nail 40.

In addition, an embodiment of the invention may be characterized in that an optical refractive index of the photo-cured adhesive member 30 and the optical refractive index of the artificial nail body 20 are substantially the same. Therefore, the pattern 260 formed in the first surface 241 is no longer identified with users' eyes when the adhesive member 30 is cured and the artificial nail body 20 is attached to the user's natural nail 40.

Figure 3A:
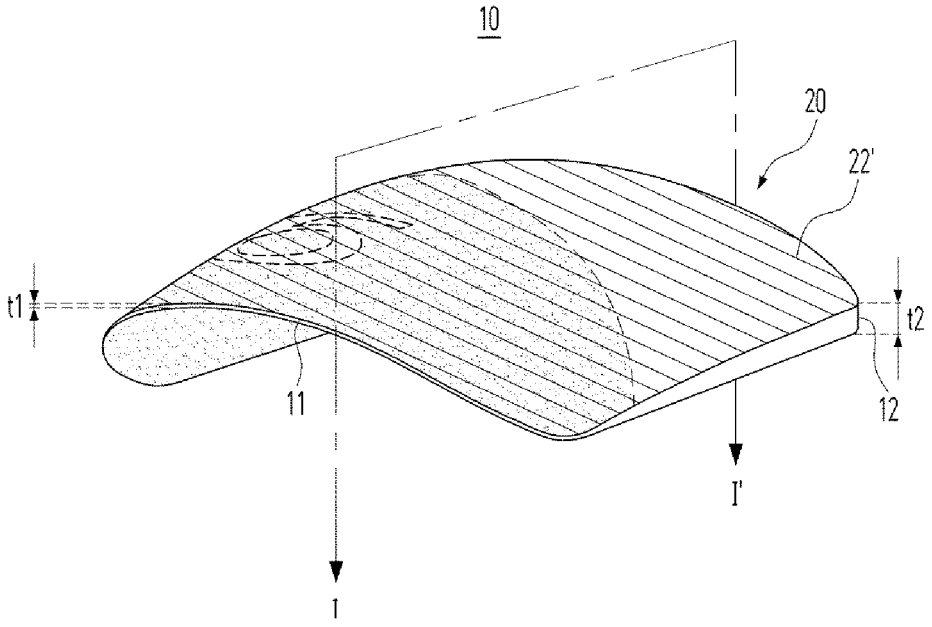
FIG. 3A is a perspective view of another embodiment of an upper surface of an artificial nail body constructed according to the principles of the invention.
Figure 3B:
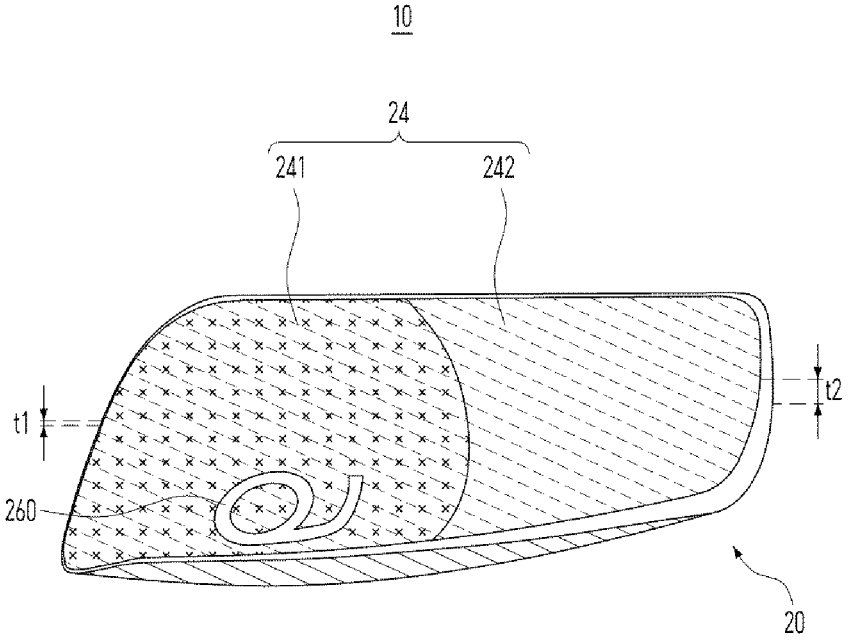
FIG. 3B is a perspective view of a lower surface of the artificial nail body shown in FIG. 3A.
Figure 3C:
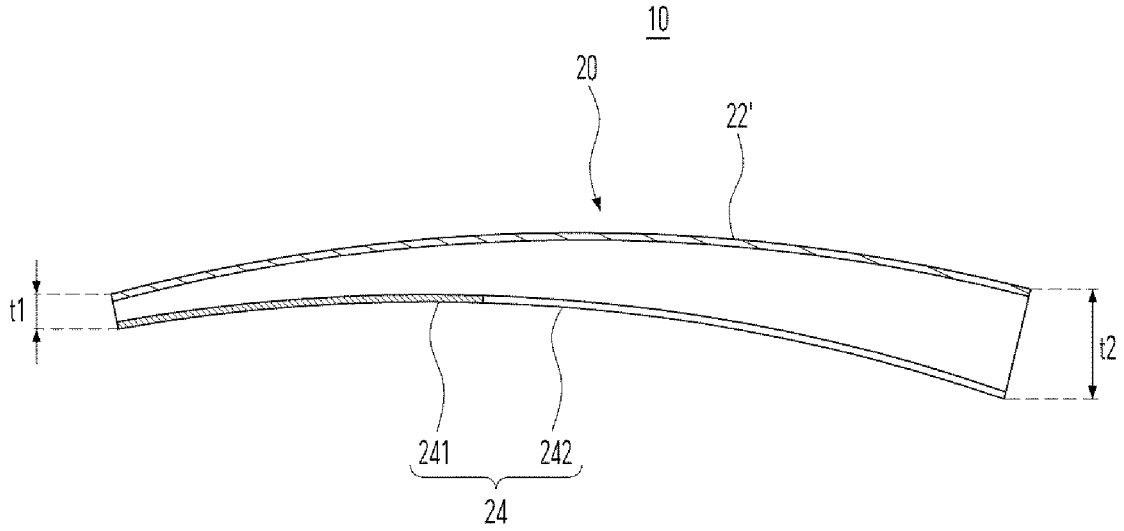
FIG. 3C is a cross-sectional view of the artificial nail body taken along line I-I' of FIG. 3A.

FIG. 3A is a perspective view of another embodiment of an upper surface of an artificial nail body constructed according to the principles of the invention, FIG. 3B is a perspective view of a lower surface of the artificial nail body shown in FIG. 3A, and FIG. 3C is a cross-sectional view of the artificial nail body taken along line I-I' of FIG. 3A.

Referring to FIGS. 3A, 3B, and 3C, compared with the embodiment (a first embodiment) shown in FIGS. 1A to 1C mentioned above, all of the elements of a second embodiment illustrated in FIGS. 3A to 3C that are labeled in the same manner as those provided in the first embodiment illustrated in FIGS. 1A to 1C are the same or similar elements.

That is, the artificial nail 10 according to another embodiment (the second embodiment) shown in FIGS. 3A to 3C is also curved with a predetermined curvature similar to the shape of a natural nail 40 and includes an artificial nail body 20 having a concave lower surface 24 and an adhesive member 30 disposed onto a first surface 241 of the lower surface 24 of the artificial nail body 20.

However, the difference between the first embodiment and the second embodiment is that, as shown in FIG. 3A, the upper surface 22' of the artificial nail body 20 is also laser-etched to have a second roughness. Therefore, user can more elaborately and stably decorate the upper surface 22' of the artificial nail body 20.

In an embodiment, however, the second roughness of the upper surface 22' may be lower than the first roughness of the first surface 241 of the lower surface 24 of the artificial nail body shown in FIG. 3B.

Figure 4A:
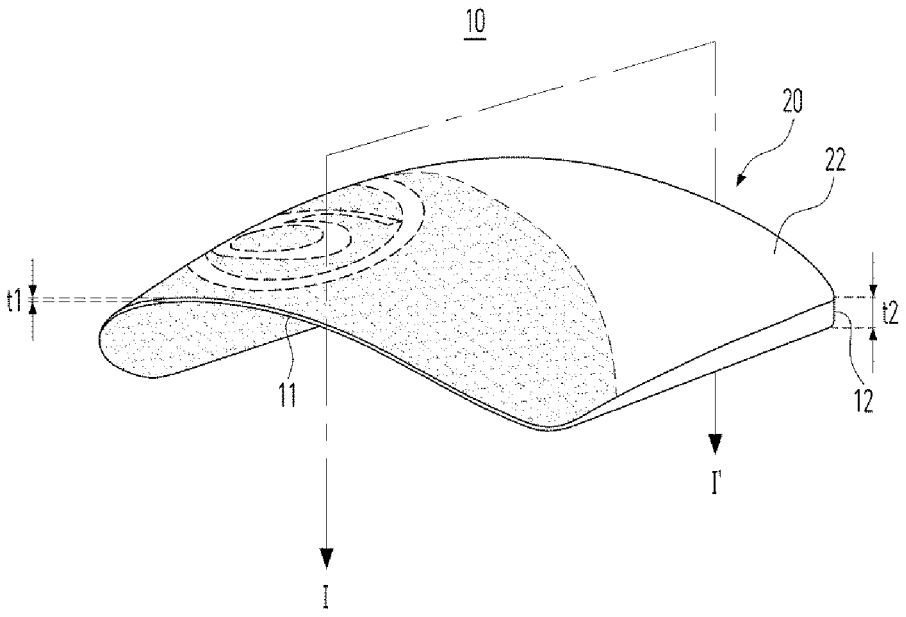
FIG. 4A is a perspective view of still another embodiment of an upper surface of an artificial nail body constructed according to the principles of the invention.
Figure 4B:
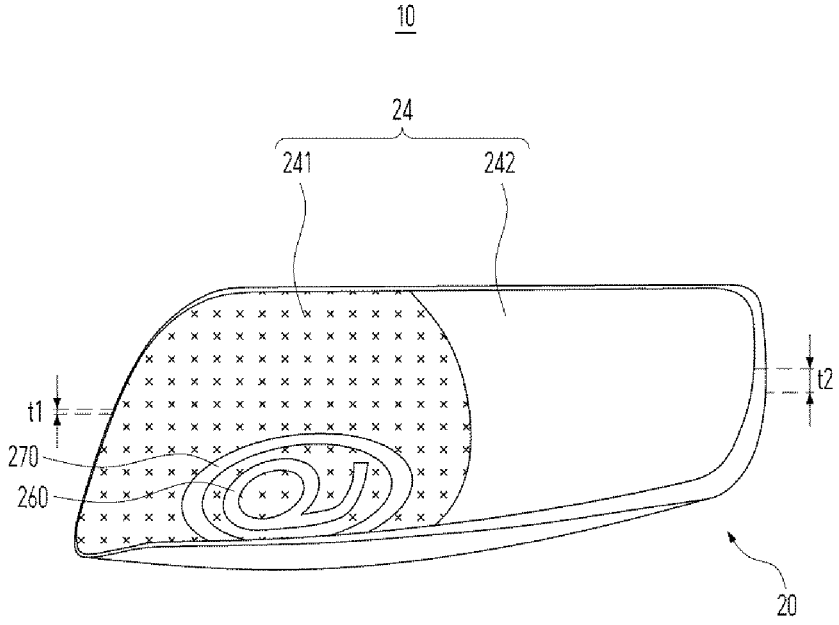
FIG. 4B is a perspective view of a lower surface of the artificial nail body shown in FIG. 4A.
Figure 4C:
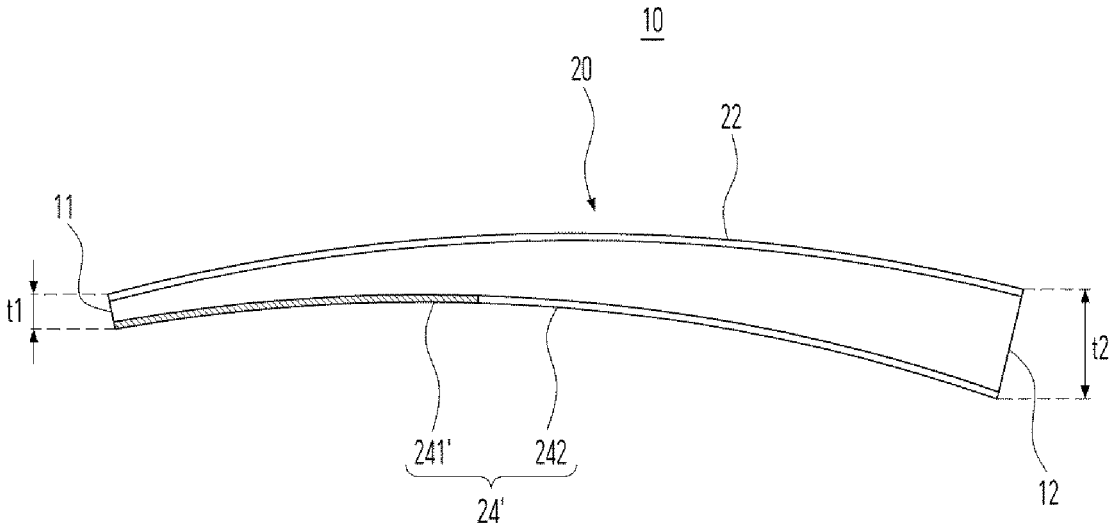
FIG. 4C is a cross-sectional view of the artificial nail body taken along line I-I' of FIG. 4A.

FIG. 4A is a perspective view of still another embodiment of an upper surface of an artificial nail body constructed according to the principles of the invention, FIG. 4B is a perspective view of a lower surface of the artificial nail body shown in FIG. 4A, and FIG. 4C is a cross-sectional view of the artificial nail body taken along line I-I' of FIG. 4A.

Referring to FIGS. 4A, 4B, and 4C, compared with the embodiment (the first embodiment) shown in FIGS. 1A to 1C mentioned above, all of the elements of a third embodiment illustrated in FIGS. 4A to 4C that are labeled in the same manner as those provided in the first embodiment illustrated in FIGS. 1A to 1C are the same or similar elements.

That is, the artificial nail 10 according to the third embodiment shown in FIGS. 4A to 4C is also curved with a predetermined curvature similar to the shape of a natural nail 40 and includes an artificial nail body 20 having a concave lower surface 24 and an adhesive member 30 disposed onto a first surface 241 of the lower surface 24 of the artificial nail body 20.

However, the difference between the first embodiment and the third embodiment is that, as shown in FIG. 4B, a guide line pattern 270 defining a position where the adhesive member 30 is to be applied is formed inside of the first surface 241' of the lower surface 24'. Therefore, it is capable of optimizing the amount and area to which the adhesive member is applied.

In this case, the guide line pattern 270 may have a closed loop shape surrounding a predetermined pattern (e.g., a number-shaped pattern) 260 formed in the first surface 241'. The guide line pattern 270 may be recognized as a region having high gloss characteristics because a laser etching process is not performed on the guide line pattern 270 in the same manner as the predetermined pattern 260. The guide line pattern 270 may be formed by being embossed or debossed.

In addition, as mentioned above, since the optical refractive index of the cured adhesive member 30 and the optical refractive index of the artificial nail body 20 are substantially the same, the guide line pattern 270 formed in the first surface 241' is no longer identified with users' eyes when the adhesive member 30 is cured and the artificial nail body 20 is attached to the user's natural nail 40.

Figure 5:
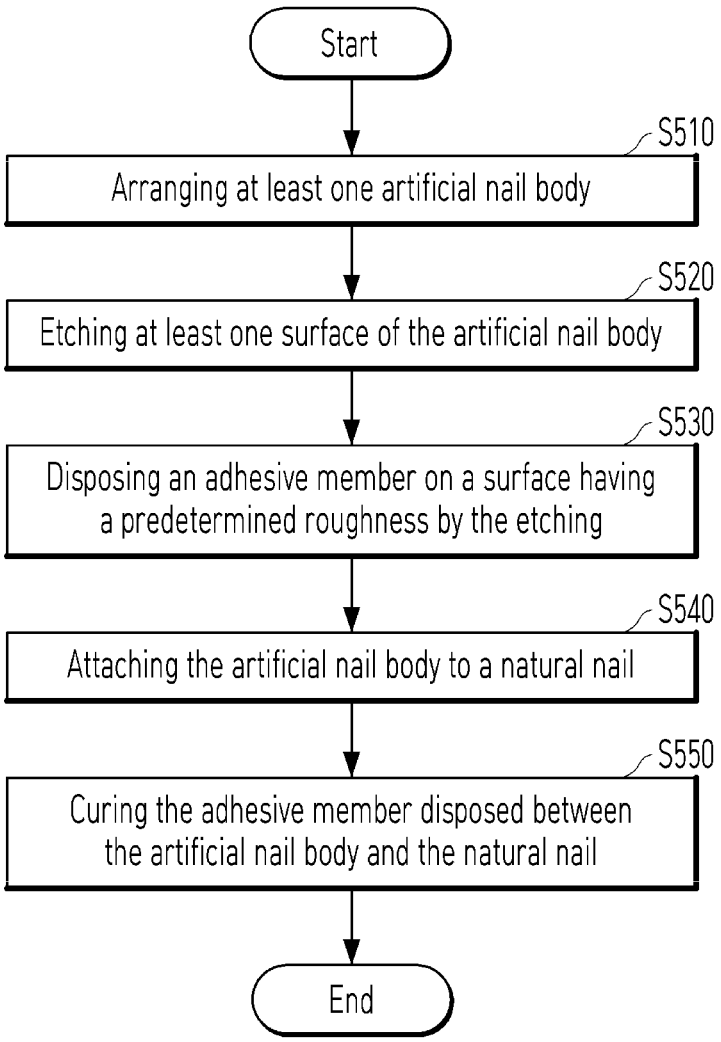
FIG. 5 is a flowchart illustrating a method of manufacturing an artificial nail according to an embodiment of the invention.

FIG. 5 is a flowchart illustrating a method of manufacturing an artificial nail according to an embodiment of the invention. In particular, in the embodiment shown in FIG. 5, a laser etching process is performed to make at least one surface of the artificial nail body have a predetermined roughness, but embodiments of the invention are not limited thereto. Thus, the predetermined roughness may be also obtained by using a sand blast method or the like instead of the laser etching process.

Referring to FIG. 5, a manufacturing method of an artificial nail according to an embodiment of the invention is as follows.

First, the manufacturing method of the artificial nail may include a step of arranging a plurality of artificial nail bodies (S510), a step of laser etching at least one surface of the artificial body (S520), and a step of disposing an adhesive member on a surface having a predetermined roughness by the laser etching (S530). Thereafter, by operating further steps including a step of attaching the artificial nail body to a natural nail (S540) and a step of curing the adhesive member disposed between the artificial nail member and the natural nail (S550), the artificial nail body can be stably attached to the user's natural nail.

Specifically, the step of arranging a plurality of artificial nail bodies (S510) includes a step of arranging a plurality of artificial nail bodies 20 having a size capable of covering the natural nail and curved with a predetermined curvature and having a concave lower surface.

For example, the artificial nail body 20 may be made of ABS resin (Acrylonitrile Butadien Styrene) having impact resistance and flexibility. Further, if necessary, in addition to the ABS resin, the artificial nail body 20 may be made of using at least one of polystyrene (PS) resin, SBS block resin, EVA (Ethylene Vinyl Acetate) resin, polycarbonate resin, and acrylic resin.

In addition, in the step of arranging the artificial nail bodies (S510), the plurality of artificial nail bodies 20 may be arranged so that the first surface 241 of the lower surface 24 of the plurality of bodies 20 may be laser-etched.

In this case, the thicknesses of both ends of the artificial nail body 20 may be different from each other. The artificial nail body 20 may have a first end edge 11 having a first thickness t1 and overlapping the natural nail 40, and a second end edge 12 opposite the first end edge 11 having a second thickness t2 different from the first thickness. Specifically, the second thickness t2 may be thicker than the first thickness t1 about over four times, as such users can attach and detach the artificial nail body 20 from the natural nail 40 more safely. In an embodiment, the first thickness t1 may be about 0.12 to 0.15 mm, and the second thickness t2 may be about 1 to 1.1 mm. Therefore, the artificial nail body 20 may have a shape gradually becoming thicker from the first end edge 11 to the second end edge 12.

Next, at least one surface of the artificial nail body may be laser-etched (S520). Specifically, the lower surface 24 of the artificial nail body 20 includes a first surface 241 overlapping the natural nail 40 and a second surface 242 other than the first surface 241, and the first surface 241 is laser-etched to have a first roughness. Accordingly, the first roughness of the first surface 241 may be greater than a roughness of the second surface 242.

Optionally, the upper surface 22 of the artificial nail body 20 is also laser-etched to have a second roughness. Therefore, user can more elaborately and stably decorate the upper surface 22 of the artificial nail body 20. In an embodiment, however, the second roughness of the upper surface 22 has a lower roughness than the first roughness of the first surface 241 of the lower surface 24 of the artificial nail body.

In an embodiment, during operating the step of laser etching process (S520), a step of forming a predetermined pattern 260 that is not laser-etched on the inside of the first surface 241 of the lower surface 24 may be further operated.

For example, referring to FIG. 1B, the predetermined pattern 260 may include the shape of a number, and such a number pattern 260 may perform a function of distinguishing a plurality of artificial nail bodies which are provided in a package. The predetermined pattern 260 may be formed by being embossed or debossed.

Further, in an embodiment, during operating the step of laser etching process (S520), a step of forming a guide line pattern 270 defining a position where the adhesive member 30 is to be applied may be further operated. Therefore, it is capable of optimizing the amount and area to which the adhesive member is applied.

For example, referring to FIG. 4B, the guide line pattern 270 may have a closed loop shape surrounding a predetermined pattern (e.g., a number-shaped pattern) 260 formed in the first surface 241. The guide line pattern 270 may be recognized as a region having high gloss characteristics because a laser etching process is not performed on the guide line pattern 270 in the same manner as the predetermined pattern 260. The guide line pattern 270 may be formed by being embossed or debossed.

After the artificial nail body 20 is manufactured by operating the above steps, then a step of applying a liquid or gel type adhesive member 30 on the first surface having the first roughness (S530) may be processed.

When the adhesive member 30 is applied to the first surface 241, since an adhesive strength of the adhesive member 30 is improved by the first roughness of the first surface 241, the artificial nail body 20 can be fixed to the natural nail 40 more stable.

The adhesive member (e.g., liquid or gel type adhesive material) 30 disposed on the first surface 241 is configured to adhere to an upper surface of the natural nail 40 when applied thereto. For example, the adhesive member 30 may include, e.g., a copolymer of acrylic ester and vinyl acetate formed from an aqueous acrylic copolymer emulsion. In addition, the adhesive member 30 may contain a pressure-sensitive adhesive material, and preferably may further include a photo-curable material. For example, the adhesive member 30 may include an acrylic oligomer having a viscosity in a gel form.

Then, when the adhesive member 30 is applied to the first surface 241 having the first roughness, the artificial nail body 20 may be fixed to the user's natural nail by the steps of attaching the artificial nail to a natural nail (S540) and curing the adhesive member disposed between the artificial nail member and the natural nail (S550).

Specifically, after the adhesive member 30 is applied to the first surface 241 having the first roughness, when the artificial nail body 20 and the adhesive member 30 are attached to the natural nail 40 through a predetermined pressure (S540) and light (e.g., UV light) is irradiated for a predetermined time to cure the adhesive member 30 (S550), the artificial nail body 20 can be more stably fixed to the natural nail 40.

In addition, an embodiment of the invention may be characterized in that the optical refractive index of the photo-cured adhesive member 30 and the optical refractive index of the artificial nail body 20 are substantially the same. Therefore, patterns (e.g., the number pattern 260 and the guide line pattern 270) formed in the first surface 241 is no longer identified with users' eyes when the adhesive member 30 is cured and the artificial nail body 20 is attached to the user's natural nail 40.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. An artificial nail comprising:

an artificial nail body having an upper surface and a lower surface including a first surface and a second surface other than the first surface; and an adhesive member disposed on the first surface of the lower surface of the artificial nail body, wherein at least one portion of the first surface has a first roughness greater than a roughness of the second surface, wherein the first surface of the lower surface includes a predetermined pattern which is not surface treated and having a roughness same as the roughness of the second surface, wherein the first surface of the lower surface further includes a guide line pattern which is not surface treated and having a closed loop shape surrounding the predetermined pattern with a roughness same as the roughness of the second surface, and wherein the closed loop guide line pattern serves as an alignment reference for positioning the artificial nail.

2. The artificial nail according to claim 1, wherein the artificial nail body includes a first end edge having a first thickness, and a second end edge opposite the first end edge having a second thickness different from the first thickness.

3. The artificial nail according to claim 2, wherein the second thickness is about four times thicker then the first thickness.

4. The artificial nail according to claim 2, wherein the first thickness is about 0.12 to 0.15 mm, and the second thickness is about 1 to 1.1 mm.

5. The artificial nail according to claim 2, wherein the artificial nail body has a shape gradually being thicker from the first end edge to the second end edge.

6. The artificial nail according to claim 1, wherein the upper surface has a second roughness greater than the roughness of the second surface by being surface treated.

7. The artificial nail according to claim 6, wherein the second roughness of the upper surface is lower than the first roughness of the first surface of the lower surface.

8. The artificial nail according to claim 1, wherein the predetermined pattern includes a pattern in the shape of a number, and the predetermined pattern is formed by being embossed or debossed.

9. The artificial nail according to claim 1, wherein the guide line pattern is formed by being embossed or debossed.

10. The artificial nail according to claim 1, wherein the adhesive member includes a photo-curable material.

11. The artificial nail according to claim 10, wherein an optical refractive index of the photo-cured adhesive member and an optical refractive index of the artificial nail body are substantially the same.

* * * * *